United States Patent [19]
Templin et al.
[11] Patent Number: 4,518,394
[45] Date of Patent: May 21, 1985

[54] WAX-IMPREGNATED FIRE KINDLING STICKS

[75] Inventors: Philip R. Templin, Oakmont; Elizabeth L. Fareri, Pittsburgh, both of Pa.

[73] Assignee: Gulf Research & Development Company, Pittsburgh, Pa.

[21] Appl. No.: 333,304

[22] Filed: Dec. 22, 1981

[51] Int. Cl.[3] ..... C10L 11/02; C10L 11/06
[52] U.S. Cl. ..... 44/38; 44/41
[58] Field of Search ..... 44/38, 41, 6

[56] References Cited

U.S. PATENT DOCUMENTS 235,756 12/1880 Elliott ..... 44/6
2,007,694 7/1935 Rutherford ..... 44/41
2,094,661 10/1937 Macleay et al. ..... 44/41
2,107,054 2/1938 Haymond ..... 44/41
2,811,428 10/1957 Smith ..... 44/41

*Primary Examiner*—Carl F. Dees
*Attorney, Agent, or Firm*—Deane E. Keith; Forrest D. Stine

[57] ABSTRACT

Porous cellulosic fiberboard having a density of at least about 16.0 pounds per cubic foot is impregnated with a hydrocarbon wax having a conjealing point of at least 135° F. The resulting combination contains less wax and has a longer burn time than lower density cellulosic fiberboard impregnated with a lower congealing point wax.

3 Claims, No Drawings

WAX-IMPREGNATED FIRE KINDLING STICKS

SUMMARY OF THE INVENTION

Cellulosic fiberboard compositions can be produced in stick-like shapes and impregnated with a hydrocarbon wax. These combustible sticks can be utilized for starting charcoal, wood and coal fires, such as in grills, in fireplaces and in furnaces. One of the primary considerations affecting the efficacy of these fire igniting sticks in the total burn time of the wax-impregnated stick. We have discovered that when the fiberboard is produced with a greater density and when the more dense board is impregnated with a paraffin or microcrystalline wax of higher congealing point, the burn time and the resulting fuel-ignition effectiveness of the stick is substantially increased, even though a lower overall quantity of wax is used.

DESCRIPTION OF THE INVENTION

The commercial production of cellulosic fiberboard in sheet form for use in residential and commercial construction as thermal and sound insulating barrier material is well established. When this fiberboard material is cut into suitably sized strips, the resulting sticks can be impregnated with a combustible hydrocarbon wax and used as kindling for starting log and coal fires.

We have made the surprising discovery that the total burn time of the wax-impregnated fire kindling stick can be substantially increased, even though a lower quantity of wax is used if a board of greater density is used and if this board is impregnated with a wax of higher congealing point. The use of a hydrocarbon wax in the fire-starting stick ensures that the combustion is uniform and hot. However, a critical factor governing the effectiveness of the sticks as fire starters, particularly with coal and larger sized logs, is the duration time of the combustion. It is generally desired that the burn time last at least about fifteen minutes and more desirably at least about twenty minutes to ensure ignition.

The fiberboard can be prepared in a conventional wet process by producing an aqueous slurry of a suitable cellulosic material and a suitable binder, and laying down and dewatering the mixture in Fourdrinier-type equipment. Alternatively, the fiberboard can be prepared using a dry mix and calendering the mixture at a suitable pressure and temperature to obtain the desired density and porosity. The cellulosic component can be a single material or a mixture of suitable cellulosic materials obtained from wood, reclaimed paper, cotton, hemp, jute, bagasse, straw, leaves, shells, and the like. The cellulosic material will frequently contain a mixture of waste or scrap materials from a variety of sources and can include cellulosic fibers and cellulosic powders.

Another essential component of the fiberboard is an adhesive or binder. The binder not only holds the fibrous mixture together, once formed, but also helps maintain the integrity of the shape even during its combustion. The binder can be a suitable aqueous or non-aqueous adhesive depending on the process used. Suitable binder material includes water glass, vegetable starch, guar gum, a dry natural or synthetic resin, and the like. The finished board will contain between about one and about ten weight percent binder, more generally between about 2.5 and about 7.5 percent binder.

The manufacture of cellulosic fiberboard includes a compression stage in which the binder-containing cellulosic fiber material is compressed to produce a product having a desired amount of void space, and therefore of a desired density. Since a main function of cellulosic fiberboard is for insulation, sound and/or heat insulation, commercial fiberboard is generally produced with a substantial amount of void spacing. As a result, commercial sound and heat insulating fiberboard generally possesses a density less than about sixteen pounds per cubic foot. We have found that cellulosic fiberboard having a density of at least about sixteen and preferably at least about 17.5 pounds per cubic foot is particularly useful in our invention.

The above describes the preparation of relatively large sheets of fiberboard material. These sheets can vary in thickness from about 5 mm to about 30 mm and more, with a thickness within the range of about 10 mm to about 25 mm being especially suitable for the fire starter stick of our invention. Once formed the board can be slit into strips of a suitable width, such as from about 5 mm to about 50 mm wide, more generally from about 10 mm to about 35 mm wide. These strips can then be cut into a suitable length. A length between about 2.5 cm and about 75 cm can be suitably used, but a length between about 5 cm and about 50 cm is overall more convenient. The expression "stick" as used herein is intended to include rectangular, circular and rounded cross-sections, and also cubes, in which all dimensions are similar. These cubic sticks are particularly suitable in starting charcoal briquettes.

The stick-shaped substrate is next impregnated with a suitable wax, preferably a hydrocarbon wax. The sticks can suitably be submerged in a vessel of hot molten wax until the wax permeates the entire porous network of the cellulosic substrate to substantially completely fill the interconnected void space within the substrate. Since the wax will essentially fill the void volume within the fiberboard material, this void volume approximates the volume of wax incorporated into the fiberboard. In general, the fiberboard will broadly contain between about 30 to about 80 weight percent wax, more generally between about 45 and about 65 weight percent wax.

We use a suitable normally solid hydrocarbon wax, and, in particular, a suitable petroleum wax resulting from the refining of petroleum, such as a refined wax, a slack wax, a tank bottoms wax, a motor oil refinery wax, and the like in the fire kindling sticks of our invention. The wax can be a paraffin wax, a microcrystalline wax, an intermediate wax or a mixture of these waxes. Refined waxes can be graded by their congealing point, as determined by ASTM D938. According to this classification waxes generally have a congealing point of at least about 100° F. However, we have discovered that when a wax of substantially higher congealing point, such as at least about 135° F., and preferably at least about 155° F., is used to impregnate the higher density cellulosic fiberboard, the burn time of the resulting fire starter stick is substantially increased, even though the resulting fire starter stick contains a lower overall quantity of wax.

DESCRIPTION OF PREFERRED EMBODIMENTS

EXAMPLES 1–8

In the following experiments, fiberboard A is a commercial cellulosic insulation board weighing about 15.4 pounds per cubic foot, prepared from wood fiber and binder. Fiberboard S is a special product weighing about 18.0 pounds per cubic food and prepared from wood fiber and a binder and being particularly suitable for the fire kindling stick of our invention. The data in the following table was obtained by averaging the results obtained by burning two or more separate specimens in each experiment. Each specimen was lighted at one end, with the total burn time being determined at the extinction of the last flame. The sticks were 11.5 to 12.0 inches in length, were about one and one-quarter inches wide and about one-half inch thick and were dipped in the wax at a temperature between about 220° and 240° F. for thirty seconds. The results are set out in the following table in which the temperature is the ASTM D938 congealing point:

TABLE

| Ex. | Stick | Wax, °F. | % Wax in Stick | Burning Time, Minutes |
|---|---|---|---|---|
| 1 | A | 131 | 65.8 | 9.6 |
| 2 | S | 131 | 56.1 | 11.2 |
| 3 | A | 157 | 62.9 | 17.7 |
| 4 | S | 157 | 50.0 | 18.5 |
| 5 | A | 160 | 61.4 | 20.0 |
| 6 | S | 160 | 52.9 | 21.5 |
| 7 | A | 173 | 60.3 | 24.8 |
| 8 | S | 173 | 49.0 | 26.9 |

The above data includes both paraffin waxes and microcrystalline waxes. It is noted that the burn time of stick S was longer than the burn time of stick A in each example where the same waxes were used, even though stick S contained substantially less wax. Also, both sticks A and S had a longer burning time as the congealing point of the impregnating wax was increased. The fire handling sticks of our invention are economically advantageous because a longer burn time is obtained with less wax.

It is to be understood that the above disclosure is by way of specific example and that numerous modifications and variations are available to those of ordinary skill in the art without departing from the true spirit and scope of the invention.

We claim:

1. A wax-impregnated fire kindling stick comprising a bonded cellulosic substrate having a density of at least about 16.0 pounds per cubic foot and impregnated with a normally solid hydrocarbon wax selected from paraffin wax, microcrystalline wax, and mixtures thereof and having a congealing point of at least about 155° F., said fire kindling stick having a burn time of at least about 15 minutes.

2. A wax-impregnated fire kindling stick in accordance with claim 1 in which the cellulosic substrate is impregnated to less than about 55 weight percent with the normally solid hydrocarbon wax.

3. A wax-impregnated fire kindling stick in accordance with claim 1 in which the density of the cellulosic substrate is at least about 17.5 pounds per cubic foot and the burn time of said fire kindling stick is at least about 20 minutes.

* * * * *